US008737873B2

(12) United States Patent
Sato et al.

(10) Patent No.: US 8,737,873 B2
(45) Date of Patent: May 27, 2014

(54) CARTRIDGE HAVING PEELING MEMBER CONFIGURED TO PEEL OFF SHEET FROM IMAGE CARRIER

(75) Inventors: Fumikazu Sato, Konan (JP); Hikaru Yoshizumi, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 113 days.

(21) Appl. No.: 13/430,770

(22) Filed: Mar. 27, 2012

(65) Prior Publication Data

US 2013/0051845 A1 Feb. 28, 2013

(30) Foreign Application Priority Data

Aug. 30, 2011 (JP) ..... 2011-186887

(51) Int. Cl.
*G03G 21/00* (2006.01)
*G03G 21/18* (2006.01)

(52) U.S. Cl.
USPC ..... 399/111; 399/113; 399/398

(58) Field of Classification Search
USPC ..... 399/110, 111, 113, 398, 399
See application file for complete search history.

(56) References Cited

U.S. PATENT DOCUMENTS

| | | | | |
|---|---|---|---|---|
| 4,761,667 | A * | 8/1988 | Miyai et al. | 399/113 |
| 4,806,985 | A * | 2/1989 | Foley et al. | 399/399 |
| 5,970,305 | A * | 10/1999 | Shin | 399/398 |
| 6,671,476 | B1 * | 12/2003 | Saiki | 399/111 |
| 2009/0285599 | A1 * | 11/2009 | Isokawa | 399/111 |

FOREIGN PATENT DOCUMENTS

| | | |
|---|---|---|
| JP | 53-139847 | 11/1978 |

* cited by examiner

*Primary Examiner* — Sophia S Chen
(74) *Attorney, Agent, or Firm* — Banner & Witcoff, Ltd.

(57) ABSTRACT

There is provided a cartridge including an image carrier, a first frame, a second frame, a peeling member and a pressing portion. The first frame has a pair of first wall portions rotatably supporting the image carrier and a second wall portion extending along an axis direction of the image carrier to connect the pair of first wall portions. The second frame is attached to the first frame so as to cover the image carrier. The peeling member has a peeling portion projecting from the second wall portion toward the image carrier and being configured to peel off a sheet from the image carrier by the peeling portion. The pressing portion is provided to the second frame, which is configured to move the peeling portion closer to the image carrier by pressing and elastically deforming the second wall portion.

12 Claims, 9 Drawing Sheets

6
100
110
61A
120
130
140
150
150(151)
170
172
200
210
220
230
240
252
252
C
X
X
UPPER
FRONT
LEFT
LOWER
RIGHT
REAR

CARTRIDGE HAVING PEELING MEMBER CONFIGURED TO PEEL OFF SHEET FROM IMAGE CARRIER

CROSS-REFERENCE TO RELATED APPLICATIONS

This application claims priority from Japanese Patent Application No. 2011-186887 filed on Aug. 30, 2011, the entire contents of which are incorporated herein by reference.

TECHNICAL FIELD

Aspects of the present invention relate to a cartridge having a peeling member configured to peel off a sheet from an image carrier.

BACKGROUND

In the related art, a sheet peeling claw (peeling member) for peeling off a sheet from the surface of an image carrier, such as a photosensitive member on which a developer image is formed, is known (for example, see JP Utility Model Application Publication No. S53-139847).

SUMMARY

However, a wall, to which the above-described peeling member is provided, elongates in an axis direction of an image carrier. Therefore, the wall is liable to be deflected in a direction in which a portion near a center thereof in the axis direction moves close to or away from the image carrier. If the wall is deflected especially in a direction away from the image carrier, the peeling member is also moved away from the image carrier. Therefore, a function of peeling off a sheet from the surface of the image carrier may deteriorate.

Accordingly, aspects of the present invention have been made in view of the above-described situations, and the subject to be solved is to suppress the separation of a peeling member from an image carrier.

According to an aspect of the present invention, there is provided a cartridge including an image carrier, a first frame, a second frame, a peeling member and a pressing portion. A developer image is configured to be formed on the image carrier. The first frame has a pair of first wall portions rotatably supporting the image carrier and a second wall portion extending along an axis direction of the image carrier to connect the pair of first wall portions, the pair of first wall portions and the second wall portion surrounding the image carrier. The second frame is attached to the first frame so as to cover the image carrier that is surrounded by the pair of first wall portions and the second wall portion. The peeling member has a peeling portion projecting from the second wall portion toward the image carrier and being configured to peel off a sheet from the image carrier by the peeling portion. The pressing portion is provided to the second frame, which is configured to move the peeling portion closer to the image carrier by pressing and elastically deforming the second wall portion.

According to this configuration, since the pressing portion is provided to the second frame, which is configured to move the peeling portion (peeling member) closer to the image carrier by pressing and elastically deforming the second wall portion, the separation of the peeling portion (peeling member) from the image carrier can be suppressed. Accordingly, it is possible to reliably peel off the sheet from the image carrier.

The pressing portion may be provided to the center in the axis direction.

The center in the axis direction is a portion that has the largest amount of deformation when the second wall portion is deflected, and by providing the pressing portion to the center in the axis direction, it is possible to effectively suppress the deflection of the second wall portion in a direction in which the peeling portion separates from the image carrier through pressing of the pressing portion.

An engaging portion, which is engaged with the second wall portion when the second frame is attached to the first frame, may be provided to the center of the second frame in the axis direction, and the pressing portion may be provided adjacent to the engaging portion in the axis direction.

According to this configuration, since the positions of the pressing portion and the engaging portion can be easily confirmed when the second frame is attached to the first frame, it is easy to provide a configuration in which the second wall portion is pressed by the pressing portion while the engaging portion is engaged with the second wall portion.

The pressing portion may be provided on both sides of the engaging portion in the axis direction.

According to this configuration, the pressing of the second wall portion by the pressing portion can be stabilized in comparison to the configuration in which the pressing portion is provided only to one side of the engaging portion in the axis direction. Further, by installing the pressing portion adjacent to both sides of the engaging portion, force is applied to the engaging portion in a balanced manner, and thus, the engagement between the engaging portion and the second wall portion can be stabilized.

The engaging portion may have an extension portion which extends from the second frame and is configured to deform and a claw portion provided to an end portion of the extension portion and engaged with the second wall portion, and the pressing portion may have a base portion extending along the extension portion from the second frame and a pressing projection portion projecting from the base portion in a pressing direction.

According to this configuration, when the pressing portion and the engaging portion are provided adjacent to each other, the engagement of the second wall portion with the engaging portion having the deflectively deformable extension portion is facilitated while, for example, increasing the rigidity of the entire pressing portion by forming the thick base portion. Accordingly, the second wall portion can be pressed efficiently and stably by the pressing portion.

The cartridge may further comprise a charging portion configured to charge the surface of the image carrier, and the charging portion may be arranged between the image carrier and the second wall portion.

Further, the cartridge may further comprise a cleaning portion configured to clean the surface of the image carrier, and the cleaning portion may be arranged between the image carrier and the second wall portion.

In the configuration in which the charging portion or the cleaning portion is arranged between the image carrier and the second wall portion, since a space for arranging the charging portion or the like between the image carrier and the second wall portion is secured, a reinforcement rib or the like is unable to be provided on the second wall portion, and thus the second wall portion is liable to be deflected. The present invention is effective in such a configuration.

A distal end of the peeling portion may be in contact with the surface of the image carrier.

According to this configuration, even in the case where the sheet is attached to the surface of the image carrier, it is possible to efficiently peel off the sheet from the image carrier.

The peeling member may be elongated from one end of the second wall portion in the axis direction toward another end of the second wall portion in the axis direction and may have an attachment portion attached to the second wall portion and at least one peeling portion projecting from the attachment portion toward the image carrier.

According to this configuration, since the attachment portion attached to the second wall portion is formed to elongate from one end of the second wall portion in the axial direction toward the other end thereof, it is possible to provide the peeling member (peeling portion) to the cartridge through attachment of one peeling member to the second wall portion. Accordingly, in comparison to the configuration in which a plurality of peeling members is attached to the second wall portion, the cartridge manufacturing process can be simplified.

The peeling member may have an attachment portion attached to the second wall portion and at least one peeling portion projecting from the attachment portion toward the image carrier, and a plurality of the peeling members may be attached side by side in the axis direction.

According to this configuration, since the plurality of the peeling members are attached side by side in the axis direction, it is possible to adjust the spacing between the peeling members (peeling portions) in the axis direction in the peeling member attachment process, and thus, the peeling portions can be arranged at the optimum positions depending on the tolerances and the like.

A plurality of peeling portions is provided side by side in the axis direction.

According to this configuration, in the entire of the image carrier in the axis direction, it is possible to successfully peel off the sheet from the image carrier.

The cartridge may further comprise a transfer portion configured to transfer the developer image that is formed on the image carrier to a sheet.

According to aspects of the present invention, since the pressing portion, which makes the peeling portion close to the image carrier by pressing and elastically deforming the second wall portion, is provided to the second frame of the cartridge, the separation of the peeling portion (peeling member) from the image carrier can be suppressed.

DETAILED DESCRIPTION

Hereinafter, exemplary embodiments of the present invention will be described in detail with reference to the drawings. In the following description, the schematic configuration of a laser printer 1 (image forming apparatus) on which a process cartridge 5 is detachably mounted as an example of a cartridge according to an exemplary embodiment of the present invention will be described, and then the detailed configuration of the process cartridge will be described.

Figure 1:
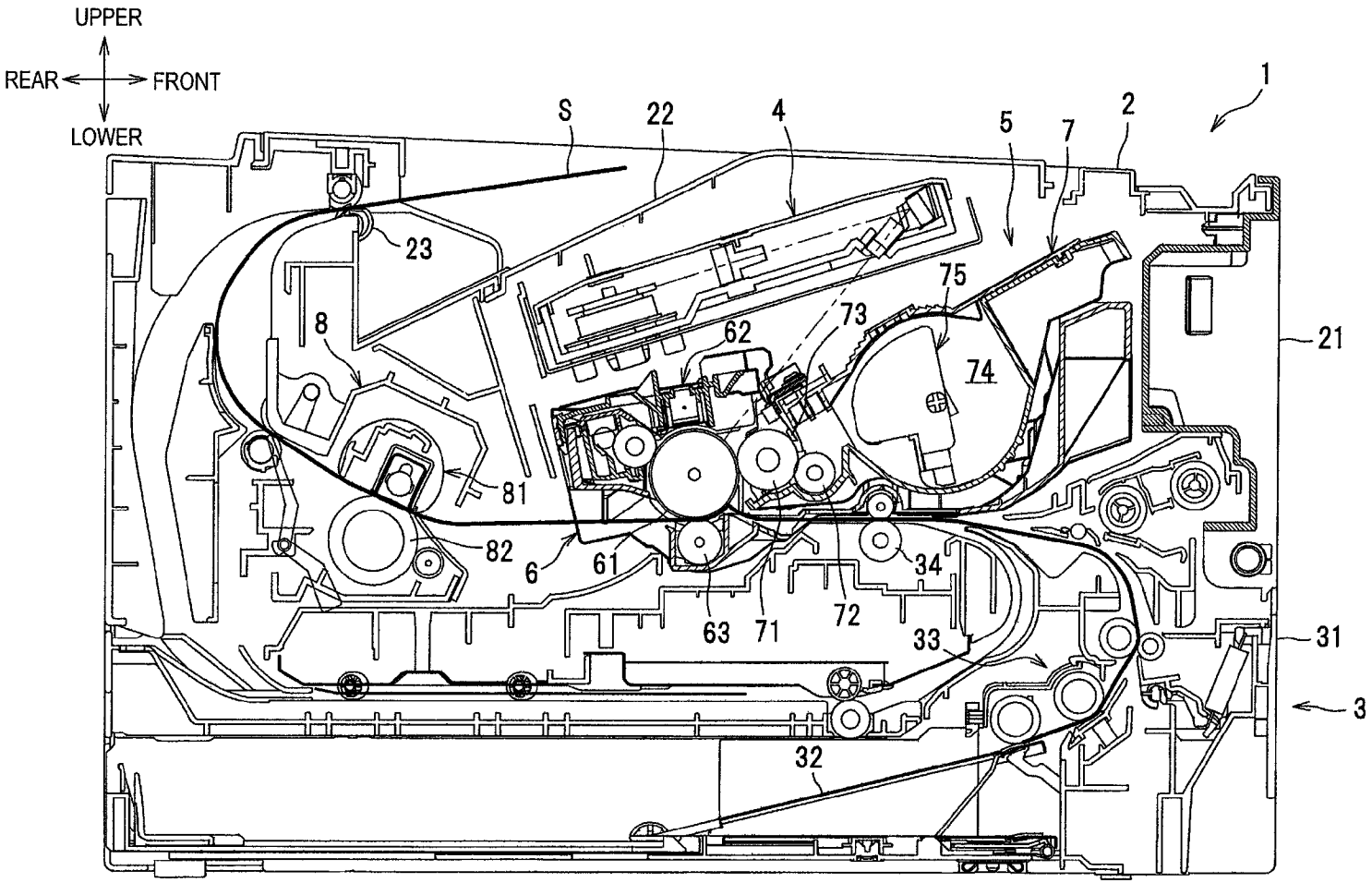
FIG. 1 is a view illustrating a schematic configuration of a laser printer having a process cartridge mounted thereon as an example of a cartridge.

Further, in the following description, directions will be described as direction based on a user who uses the laser printer 1. That is, a right side in FIG. 1 is referred to as "front", a left side in FIG. 1 is referred to as "rear", a front side in FIG. 1 is referred to as "left", and a rear side in FIG. 1 is referred to as "right". Further, an upper and lower direction in FIG. 1 is referred to as "upper-lower".

<Schematic Configuration of Laser Printer>

As illustrated in FIG. 1, a laser printer 1 mainly includes a sheet feeding portion 3 for feeding a sheet S as an example of a recording sheet, an exposure device 4, a process cartridge 5 transferring a toner image (developer image) onto the sheet S, and a fixing device 8 thermally fixing the toner image onto the sheet S, which are provided inside a body casing 2.

The sheet feeding portion 3 is provided in a lower portion of the body casing 2, and mainly includes a sheet feeding tray 31, a sheet pressing plate 32, a sheet feeding mechanism 33, and a registration roller 34. The sheet S accommodated in the sheet feeding tray 31 is transmitted upward by the sheet pressing plate 32, is supplied toward the process cartridge 5 by the sheet feeding mechanism 33, passes through the registration roller 34, and then is conveyed between a photosensitive drum 61 and a transfer roller 63.

The exposure device 4 is arranged in an upper portion in the body casing 2 and includes a laser emitting portion not shown and a polygon mirror, lenses, and reflecting mirrors, which are shown with their reference numerals omitted. In the exposure device 4, laser light (see chained line) based on image data emitted from the laser emitting portion scans the surface of the photosensitive drum 61 at high speed. In this way, the surface of the photosensitive drum 61 is exposed.

The process cartridge 5 is disposed lower to the exposure device 4 and is configured to be detachably mounted to the body casing 2 through an opening created by opening a front cover 21 provided to the body casing 2. The process cartridge 5 includes a photosensitive cartridge 6 and a developing cartridge 7.

The photosensitive cartridge 6 mainly includes the photosensitive drum 61 as an example of the image carrier, a charger 62 as an example of a charging portion, and a transfer roller 63 as an example of a transfer portion.

The developing cartridge 7 is configured to be detachably mounted to the photosensitive cartridge 6. The developing cartridge 7 is configured to be detachably mounted to the body casing 2 in a state of being mounted to the photosensitive cartridge 6. That is, the developing cartridge 7 is detachably mounted to the body casing 2 as a part of the process cartridge. The developer cartridge 7 mainly includes a developing roller 71, a supply roller 72, a layer thickness restricting blade 73, a toner accommodating part 74 accommodating toner (developer) and an agitator 75.

In the process cartridge 5, the surface of the photosensitive drum 61 is uniformly charged by the charger 62 and is then exposed by a high speed scanning of laser light from the exposure device 4. In this way, an electrostatic latent image based on the image data is formed on the photosensitive drum 61. Further, the toner in the toner accommodating part 74 is first supplied to the supply roller 72 while being agitated by the agitator 75 and then supplied from the supply roller 72 to the developing roller 71. The toner enters between the developing roller 71 and the layer thickness restricting blade 73 by the rotation of the developing roller 71 to be supported on the developing roller 71 as a thin layer having a constant thickness.

The toner supported on the developing roller 71 is supplied from the developing roller 71 to the electrostatic latent image formed on the photosensitive drum 61. Thereby, the electrostatic latent image becomes a visible image and the toner image (developer image) is formed on the photosensitive drum 61. Thereafter, the toner image on the photosensitive drum 61 is transferred onto the sheet S through transportation of the sheet S between the photosensitive drum 61 and the transfer roller 63.

The fixing device 8 is located rear to the process cartridge 5, and mainly includes a heating unit 81 and a pressing roller 82. The heating unit 81 has a halogen heater, a fixing belt and a nip which are shown without reference numerals. The pressing roller 82 is configured to hold the fixing belt with the nip plate of the heating unit 81. The fixing device 8 thermally fixes the toner image transferred onto the sheet S while the sheet S passes between the heating unit 81 and the pressing roller 82. The sheet S onto which the toner image is thermally fixed is discharged onto a sheet discharge tray 22 by a sheet discharge roller 23.

<Detailed Configuration of a Process Cartridge>

Figure 2:
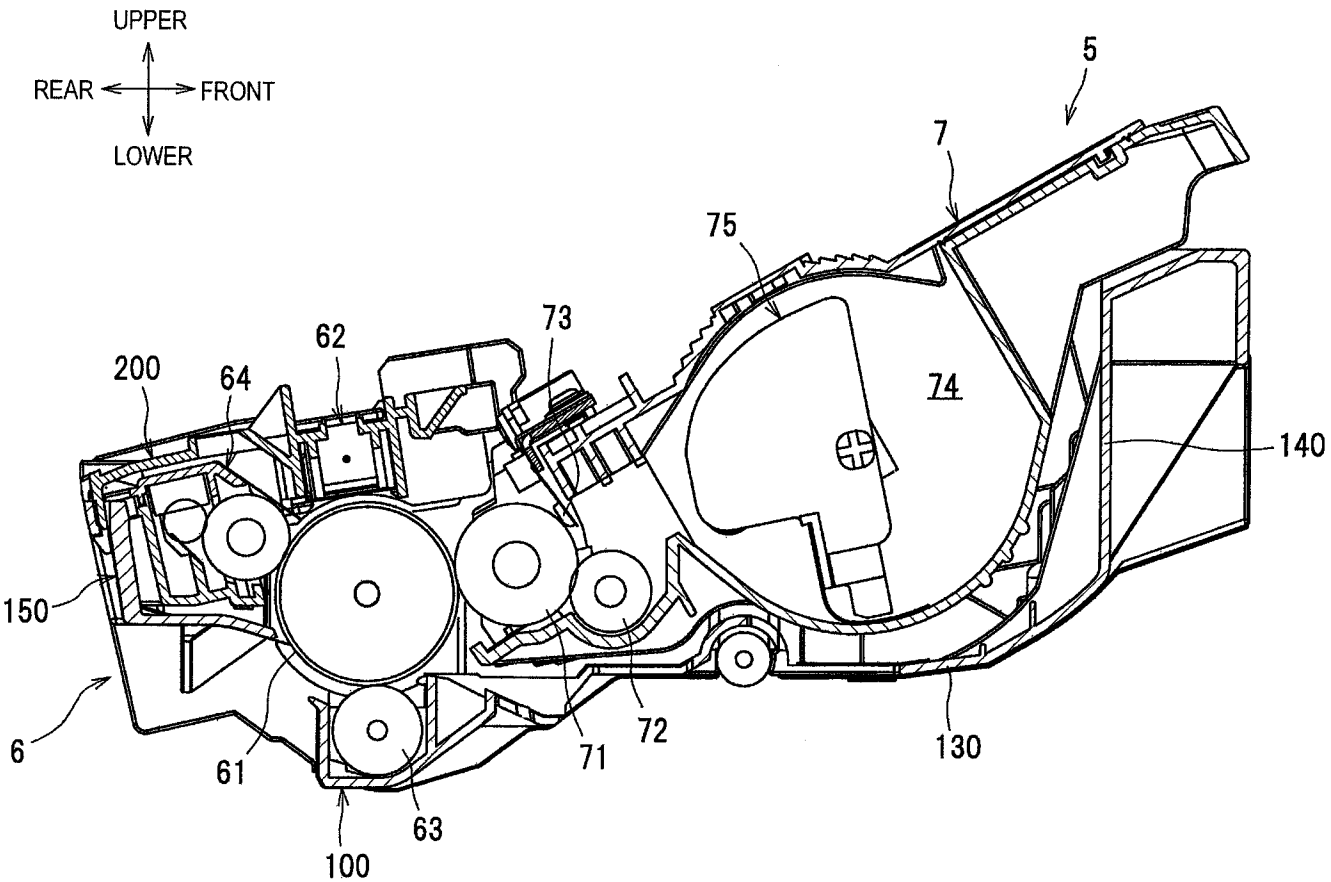
FIG. 2 is a cross-sectional view of the process cartridge.

As illustrated in FIG. 2, the process cartridge 5, more specifically, the photosensitive cartridge 6 that configures the process cartridge 5, mainly includes a cleaning unit 64 as an example of a cleaning portion, a lower frame 100 as an example of a first frame and an upper frame 200 as an example of a second frame, in addition to the photosensitive drum 61, the charger 62, and the transfer roller 63.

Figure 3:
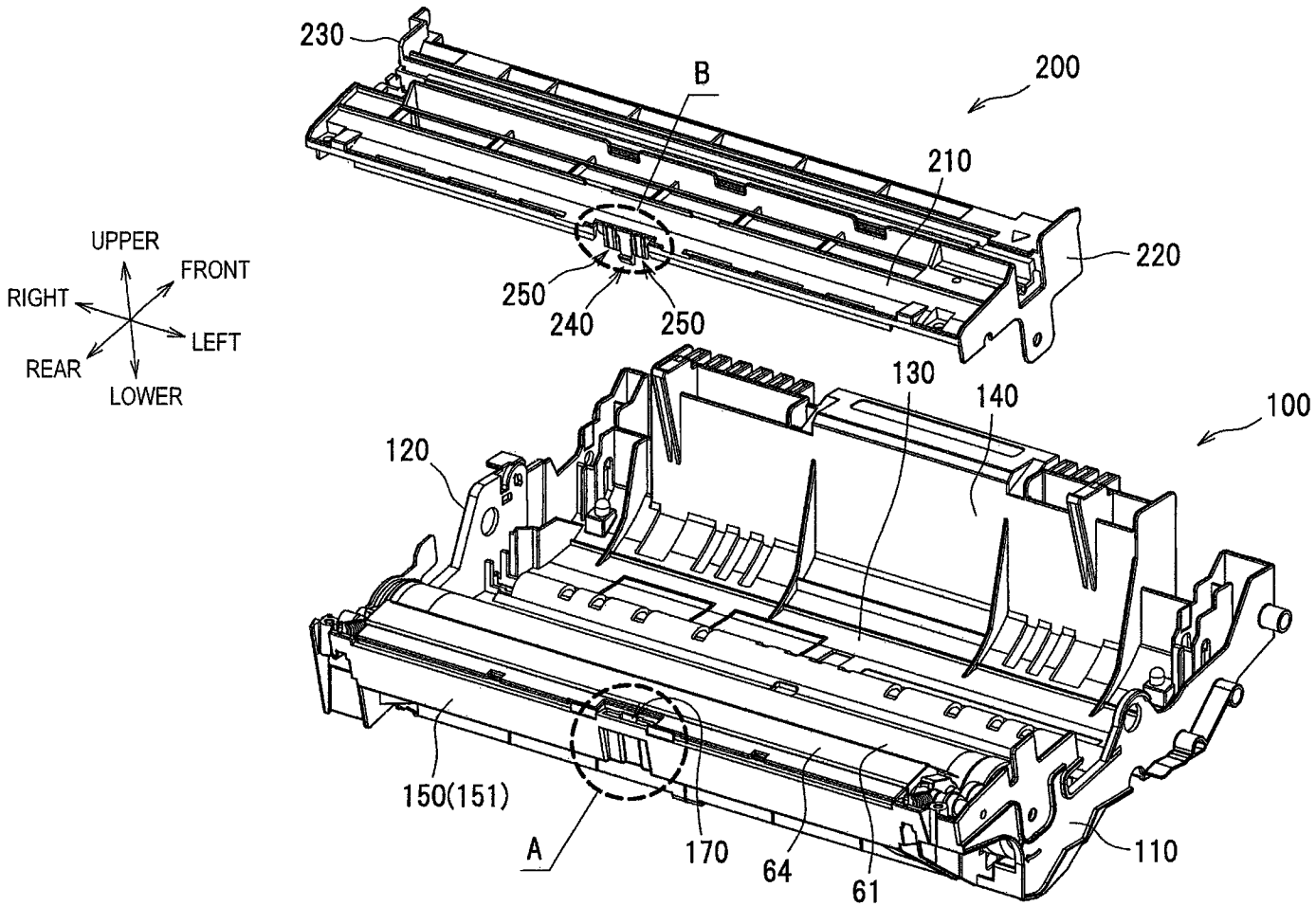
FIG. 3 is a perspective view of an upper frame and a lower frame of a photosensitive cartridge configuring the process cartridge.
Figure 4:
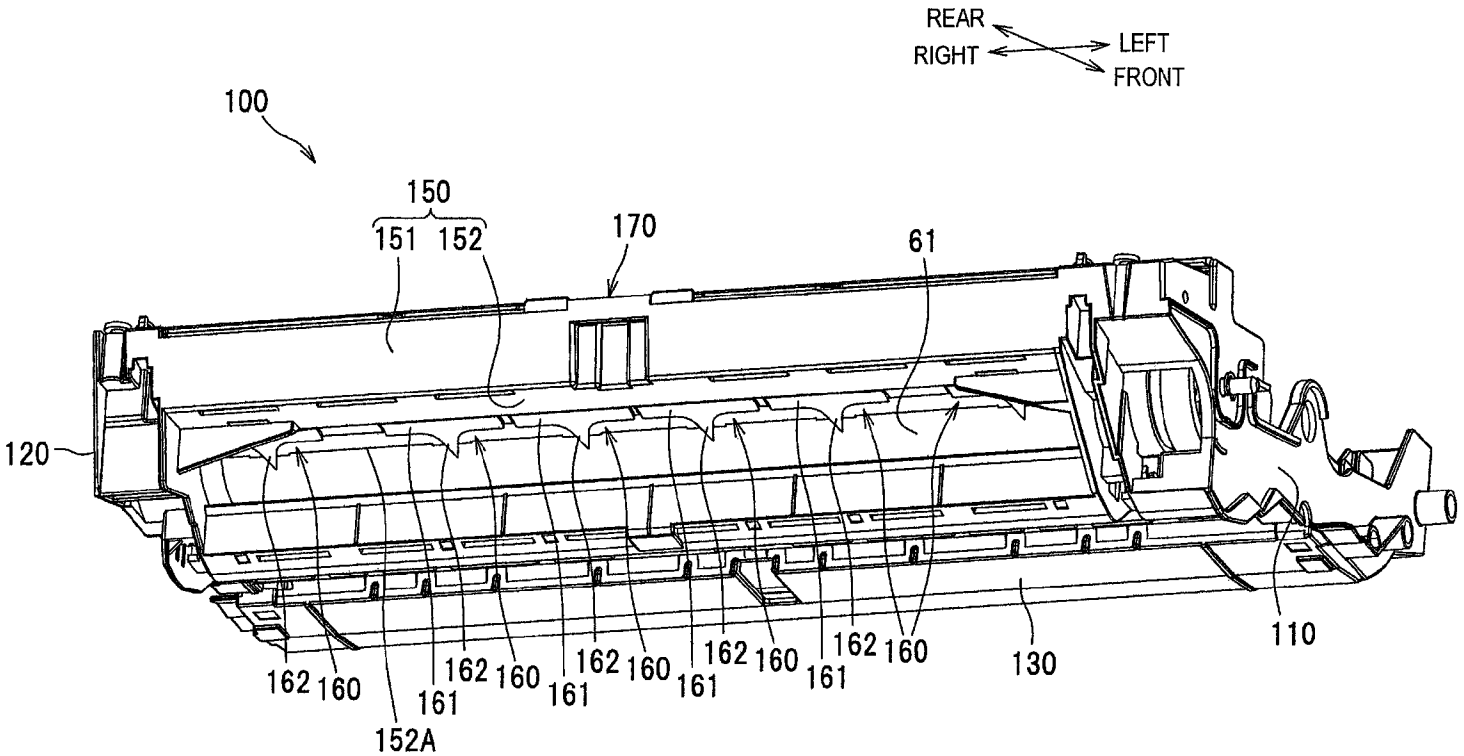
FIG. 4 is a perspective view of a rear portion of the lower frame as seen from the lower side thereof.

As illustrated in FIG. 3, the lower frame 100 mainly includes a left side wall portion 110 and a right side wall portion 120 as an example of a pair of first wall portions, a bottom wall portion 130 extending along the axis direction (left-right direction) of the photosensitive drum 61, a front side wall portion 140, a connecting wall portion 150 as an example of a second wall portion, and a peeling member 160 (see FIG. 4).

The left side wall portion 110 and the right side wall portion 120 face each other in the left-right direction, and their lower portions are connected by the bottom wall portion 130, their front portions are connected by the front side wall portion 140 and their rear portions are connected by the connecting wall portion 150. Further, the rear portions of the left and right side wall portions 110 and 120 rotatably support the photosensitive drum 61 and support the cleaning unit 64.

On the other hand, according to the exemplary embodiment, the left and right side wall portions 110 and 120 and the connecting wall portion 150 are provided in a substantially U-shape in a planar view to surround the left, right, and rear of the photosensitive drum 61 and the cleaning unit 64. Further, although not illustrated, the developing cartridge 7 is detachably mounted in a space that is surrounded by the left and right side wall portions 110 and 120, the front side wall portion 140, and the photosensitive drum 61.

As shown in FIG. 4, the connecting wall portion 150 of the lower frame 100 includes a rear wall portion 151 extending in the substantially upper-lower direction, and a lower wall portion 152 extending in the substantially front-rear direction. On the lower surface of the lower wall portion 152, a plurality of peeling members 160 are attached side by side in the left-right direction by adhering or the like.

The peeling member 160 is a member that peels off the sheet S from the photosensitive drum 61, and in this exemplary embodiment, it is formed of paper such as a synthetic paper or a paper similar in softness to the synthetic sheet. Each peeling member 160 is configured to have an attachment portion 161 attached to the lower wall portion 152, and one peeling portion 162 projecting from the attachment portion 161 toward the front.

The attachment portion 161 is formed in a substantially rectangular shape that elongates in the left-right direction. On a front end portion of the attachment portion 161 near the center in the left-right direction, the peeling portion 162 is provided. The peeling portion 162 projects from the front end portion 152A of the lower wall portion 152, to which the attachment portion 161 is attached, to the photosensitive drum 61.

The peeling portion 162 is formed in a substantially triangular shape. The peeling member 160 is attached to the lower wall portion 152 so that the front end (distal end) of the peeling portion 162 is in contact with the surface of the photosensitive drum 61. At the time of image formation, the sheet S that has been conveyed from the photosensitive drum 61 and the transfer roller 63 comes in contact with the tip of the peeling portion 162 and is peeled off from the photosensitive drum 61.

In this exemplary embodiment, since a plurality of peeling members 160, each of which having one peeling portion 162, are attached to the lower wall portion 152 side by side in the left-right direction, a plurality of peeling portions 162 are provided side by side in the left-right direction.

Figure 5:
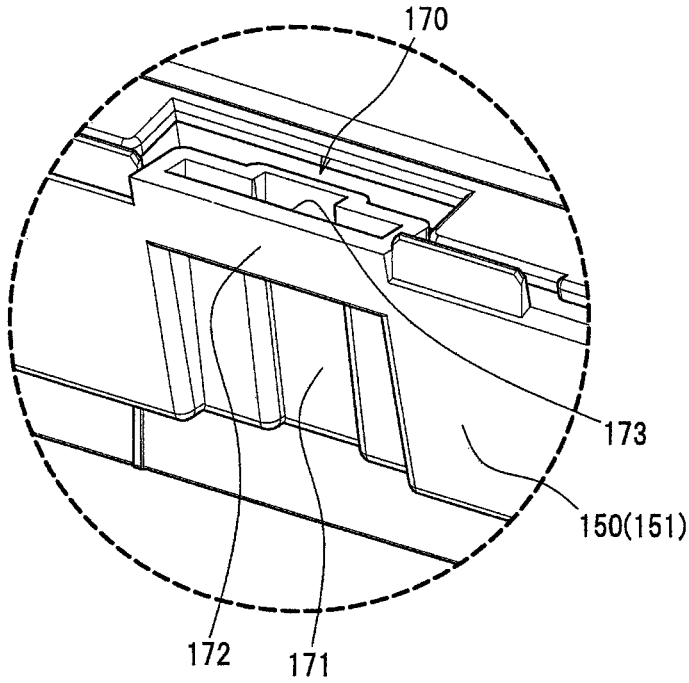
FIG. 5 is an enlarged view of portion A in FIG. 3.

As illustrated in FIG. 3, on the rear wall portion 151 of the connecting wall portion 150, an engaged portion 170, which engages with an engaging portion 240 of the upper frame 200 to be described later, is provided near the center in the left-right direction. The engaged portion 170, as illustrated in FIG. 5, includes a concave portion 171 having a concave shape which protrudes toward the front side than the rear surface of the rear wall portion 151 and a pressed wall 172 formed to cross the concave portion 171 at an upper portion of the concave portion 171. The engaged portion is formed integrally with the rear wall portion 151 (connecting wall portion 150). The engaging portion 240 engages with a hole portion 173 formed by the concave portion 171 and the pressed wall 172.

Referring again to FIG. 3, the upper frame 200 mainly includes an upper wall portion 210 and a left wall portion 220 and a right wall portion 230 which extend downward from left and right ends of the upper wall portion 210. The upper frame 200 supports a charger 62 (not illustrated in FIG. 3) and is attached to the lower frame 100 so as to cover the upper portion of the photosensitive drum 61 or the cleaning unit 64, which are surrounded by the left and right side wall portions 110 and 120 and the connecting wall portion 150 (see FIG. 7A), from above.

The engaging portion 240 and the pressing portion 250 are provided to the rear end portion of the upper wall portion 210 near the center in the left-right direction.

Figure 6:
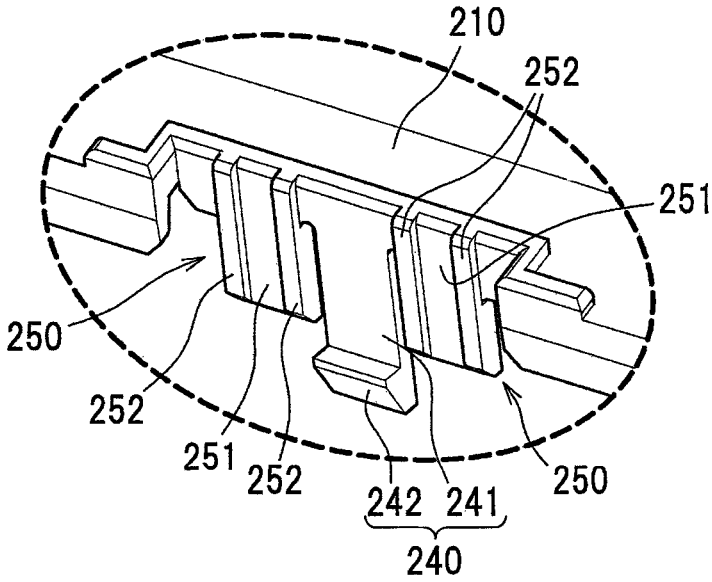
FIG. 6 is an enlarged view of portion B in FIG. 3.

The engaging portion 240 is a portion that is engaged with the connecting wall portion 150 when the upper frame 200 is attached to the lower frame 100. As illustrated in FIG. 6, the engaging portion 240 includes a deflectively deformable extension portion 241 extending downwards in the front-rear direction from the rear end portion of the upper wall portion 210 and a claw portion 242 projecting rearward from the lower end portion of the extension portion 241 and engaged with the connecting wall portion 150 (lower end of the pressed wall 172).

The pressing portion 250 is provided on both sides of the engaging portion 240 adjacent to the engaging portion 240 in the left-right direction. More specifically, the pressing portion 250 includes a base portion 251 extending downwards from both the left and right sides of the engaging portion 240 at the rear end portion of the upper wall portion 210. The base portion 251 extends along the extension portion 241 of the engagement portion 240. Further, the pressing portion 250 includes rib-shaped pressing projection portion 252 projecting rearward from the rear surface of the base portion 251 (pressing direction).

The pressing projection portion 252 extends in the upper-lower direction. Four pressing projection portions 252 are provided in total, in which two pressing projection portions 252 are provided for each base portion.

Figure 8:
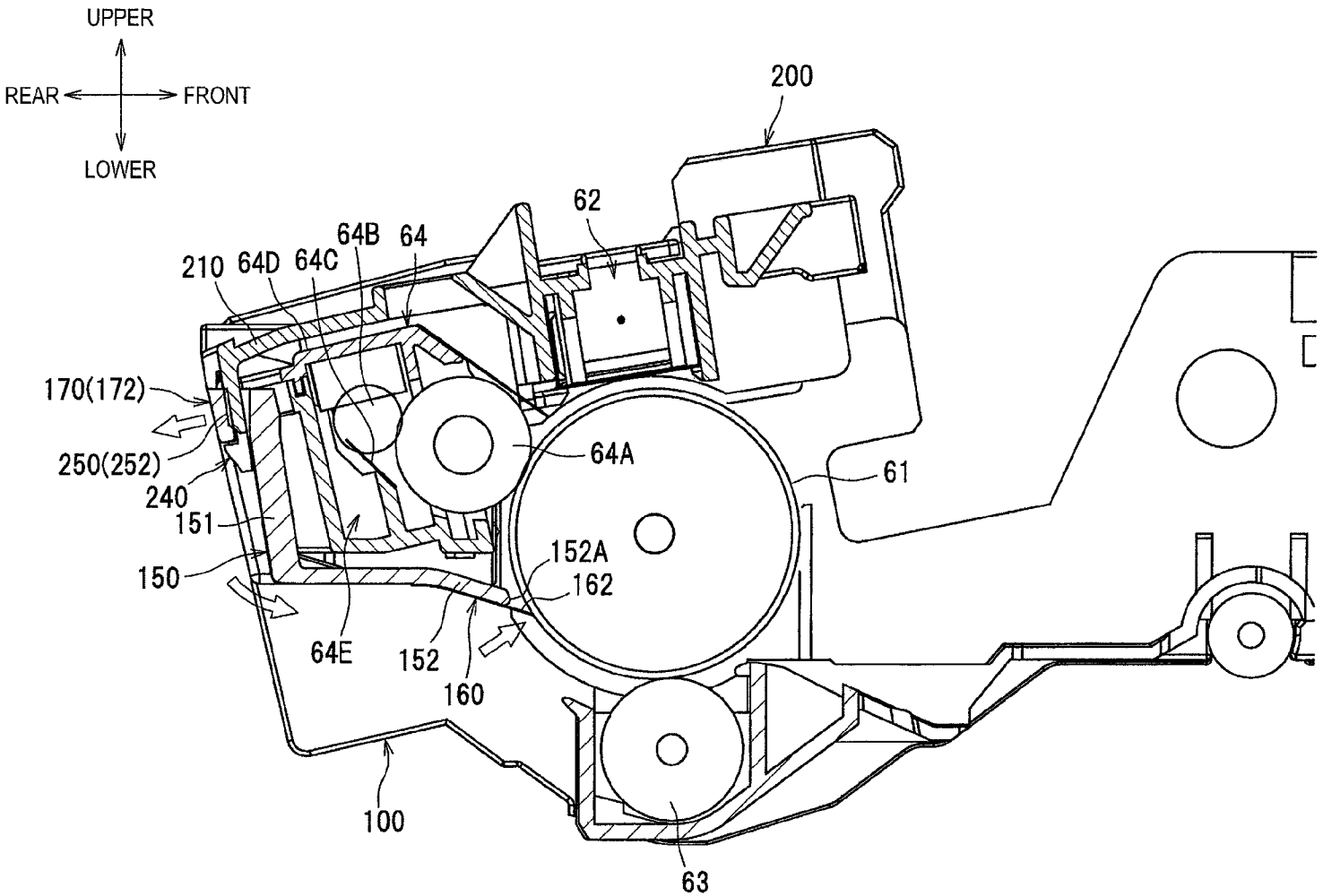
FIG. 8 is an enlarged cross-sectional view taken along line X-X of FIG. 7A.

As illustrated in FIG. 8, the cleaning unit 64 is a unit that cleans the surface of the photosensitive drum 61, and mainly includes a cleaning roller 64A, a collection roller 64B, a scrapping film 64C, and a frame 64D supporting the cleaning roller 64A and the like.

Paper dust attached to the surface of the photosensitive drum 61 is collected by the cleaning roller 64A, and is moved to the surface of the collection roller 64B. The paper dust attached to the surface of the collection roller 64B is scraped off by the scrapping film 64C, and then is accommodated in an accommodating part 64E provided to the frame 64D.

In this exemplary embodiment, the cleaning unit 64 is arranged in a space formed between the photosensitive drum 61 and the connecting wall portion 150 (rear wall portion 151) in the lower frame 100, and is supported by the lower frame 100.

Hereinafter, the above-described process cartridge 5, more specifically, the outline of assembly of the photosensitive cartridge 6 that configures the process cartridge 5 and the operation of the pressing portion 250 will be described.

As illustrated in FIG. 3, first, the transfer roller 63 (see FIG. 2) or the photosensitive drum 61, the cleaning unit 64, and the peeling member 160 are assembled to the lower frame 100, and the charger 62 is assembled to the upper frame 200.

Figures 7A, 7B:
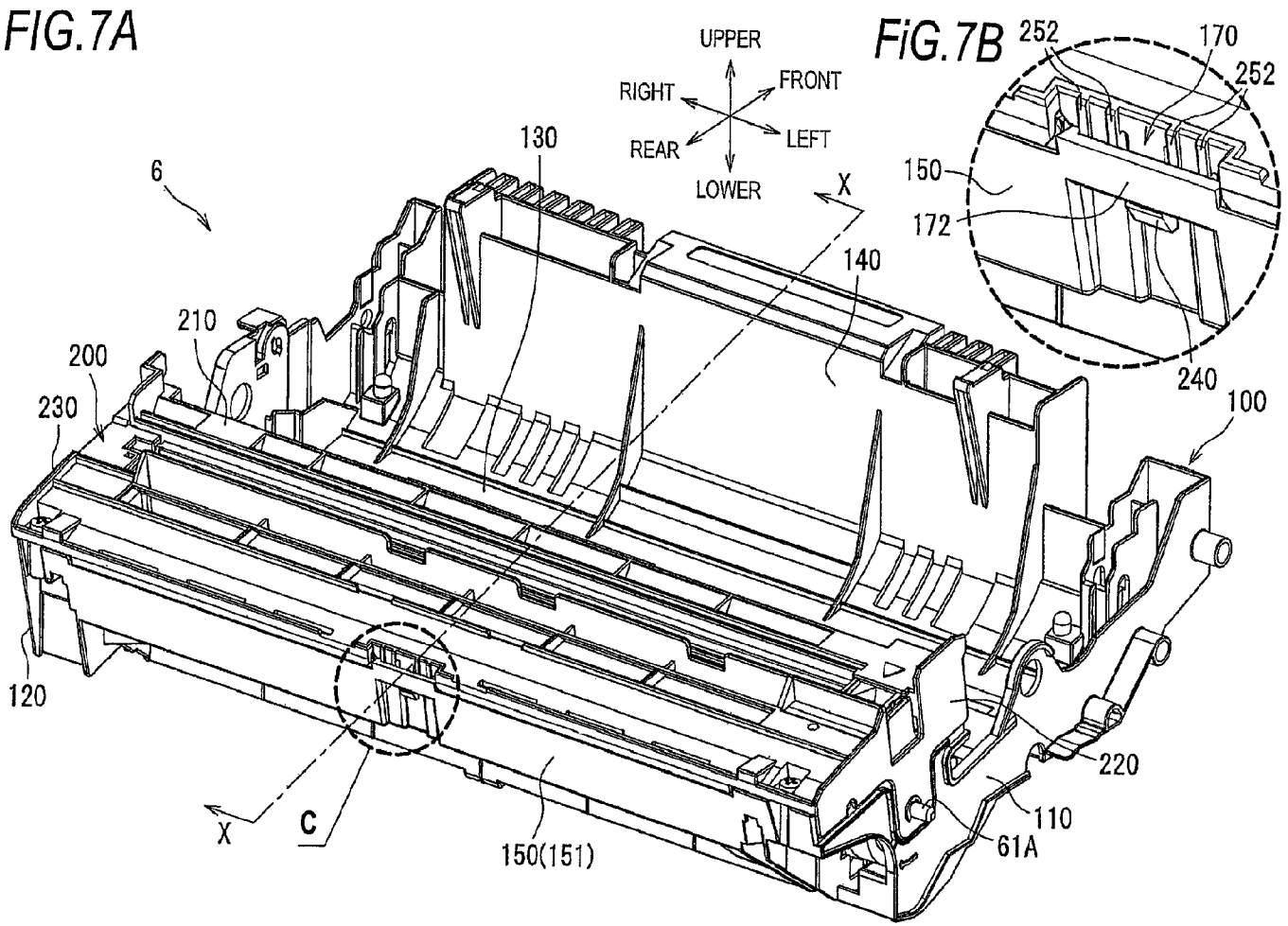
FIG. 7A is a perspective view of the photosensitive cartridge.
FIG. 7B is an enlarged view of a portion C in FIG. 7A.

Then, as illustrated in FIGS. 7A and 7B, the engaging portion 240 of the upper frame 200 is engaged with the engaged portion 170 of the lower frame 100 to assemble the upper frame 200 with the lower frame 100. In this exemplary embodiment, after assembling the lower frame 100 and the upper frame 200, a shaft 61A (metal bar) is inserted into the photosensitive drum 61 through through-holes provided in both frames 100 and 200.

As illustrated in FIG. 7B, when the engaging portion 240 is engaged with the engaged portion 170, the pressing projection portion 252 of the pressing portion 250 presses the pressed wall 172 of the connecting wall portion 150 rearward. As illustrated in FIG. 8, as the pressed wall 172 (upper portion of the rear wall portion 151) is pressed rearward, the entire connecting wall portion 150 deforms elastically and is twisted in the counterclockwise direction in FIG. 8. Accordingly, the front end portion 152A of the lower wall portion 152 is displaced obliquely upward, and a distal end of the peeling portion 162 of the peeling member attached to the lower wall portion 152 becomes close to the surface of the photosensitive drum 61 becomes in contact with the surface of the photosensitive drum 61 while being pressed.

As described above, according to this exemplary embodiment, the following effects can be obtained.

Since the pressing portion 250 is provided to the upper frame 200, which makes the peeling portion 162 (peeling member 160) close to the photosensitive drum 61 through pressing and elastically deforming the connecting wall portion 150, the separation of the peeling portion 162 from the photosensitive drum 61 can be suppressed. Accordingly, it is possible to reliably peel off the sheet S from the photosensitive drum 61.

In particular, according to this exemplary embodiment, since the distal end of the peeling portion 162 is in contact with the surface of the photosensitive drum 61, it is possible to effectively peel off the sheet S from the photosensitive drum 61 even in the case where the sheet S is attached to the surface of the photosensitive drum 61.

Further, according to this exemplary embodiment, since the plurality of peeling portions 162 are provided side by side in the left-right direction, it is possible to successfully peel off the sheet S from the photosensitive drum 61 in the entire axis direction of the photosensitive drum 61.

Further, according to this exemplary embodiment, since the pressing portion 250 is provided at the center in the left-right direction that has the largest amount of deformation when the connecting wall portion 150 is deflected, it is possible to effectively suppress the deflection of the connecting wall portion 150 in the direction in which the peeling portion 162 is separated from the photosensitive drum 61. Accordingly, the separation of the peeling portion 162 from the photosensitive drum 61 can be effectively suppressed.

Further, according to this exemplary embodiment, since the pressing portion 250 is provided adjacent to the engaging portion 240 in the left-right direction, it is easy to confirm the positions of the pressing portion 250 and the engaging portion 240 when the upper frame 200 is attached to the lower frame 100. Accordingly, it is easy to provide the configuration in which the connecting wall portion 150 is pressed by the pressing portion 250 while the engaging portion 240 is engaged with the connecting wall portion 150 (engaged portion 170).

Since the pressing portion 250 and the engaging portion 240 are provided adjacent to each other, both the engaging portion 240 and the pressing portion 250 are configured to be engaged with the hole portion 173 of the engaged portion 170. Further, since the vertical length of the extension portion 241 of the engagement portion 240 is larger than the vertical length of the base portion 251, the engaging portion 240 is first inserted into the hole portion 173, and then the pressing portion 250 is inserted into the hole portion 173. That is, according to this exemplary embodiment, by providing the pressing portion 250 and the engaging portion 240 adjacent to each other, it is possible to make the engaging portion 240 function as a guide for the pressing portion 250.

Further, according to this exemplary embodiment, since the pressing portion 250 is formed on both left and right sides of the engaging portion 240, the pressing of the connecting wall portion 150 by the pressing portion 250 can be stabilized in comparison to the configuration in which the pressing portion 250 is provided only on either of the left and right sides of the engaging portion 240. Further, by providing the pressing portion 250 adjacent to both the left and right sides of the engaging portion 240, force is applied to the engaging portion 240 in a balanced manner, and thus, the engagement between the engaging portion 240 and the second wall portion 150 can be stabilized.

Further, according to this exemplary embodiment, since the extension portion 241 of the engaging portion 240 and the base portion 251 of the pressing portion 250 are independently provided, the engagement of the connecting wall portion 150 with the engaging portion 240 having the deflectively deformable extension portion 241 is facilitated while, for example, increasing the rigidity of the entire pressing portion 250 by forming the thick base portion 251. Accordingly, the connecting wall portion 105 can be pressed efficiently and stably by the pressing portion 250.

Further, according to this exemplary embodiment, since the plurality of peeling members 160 are attached side by side in the left-right direction, it is possible to somewhat freely adjust the space between the respective peeling members 160 (peeling portions 162) in the left-right direction during the attachment process of the peeling member 160. Accordingly, the peeling portion 162 can be arranged in optimum positions depending on the tolerances and the like.

In the configuration according to the above-described exemplary embodiment, since a space for arranging the cleaning unit 64 is secured between the photosensitive drum 61 and the connecting wall portion 150, it is unable to provide a reinforcement rib or the like to the connecting wall portion 150, and thus, the connecting wall portion 150 is liable to be deflected. Accordingly, the present invention that suppresses the deflection of the connecting wall portion 150 is effective in the configuration according to the above-described exemplary embodiment.

As described above, although the exemplary embodiments of the present invention have been described, the present invention is not limited to the above-described exemplary embodiments. The specific configurations can be appropriately modified without departing from the scope of the present invention.

In the above-described exemplary embodiment, although the pressing portion 250 is provided near the center in the left-right direction (axis direction of the image carrier), the present invention is not limited thereto. For example, the pressing portion may be provided closer to one end in the axis direction of the image carrier, or one or a plurality of pressing portions may be provided on both sides of the center in the axis direction.

In the above-described exemplary embodiment, although the pressing portion 250 is provided adjacent to the engaging portion 240, the present invention is not limited thereto. For example, the engaging portion may be provided closer to one end in the axis direction and the pressing portion may be provided at the other end in the axis direction. Further, any one of the engaging portion and the pressing portion may be provided at the center in the axis direction, and the other thereof may be provided at both sides in the axis direction across the center of the axis direction.

In the above-described exemplary embodiment, as the upper portion of the rear wall portion 151 is pressed toward the rear portion by the pressing portion 250, the entire connecting wall portion 150 is elastically deformed and twisted, and thus the peeling portion 162 becomes close to the photosensitive drum 61. However, the present invention is not limited thereto. For example, as illustrated in FIG. 9, a connecting wall portion 150' may be configured so that when the rear end portion thereof is upwardly pressed by a pressing portion 250', the center in the left-right direction thereof is elastically deformed to be deflected upward and thus the front end portion is upwardly displaced to make the distal end of the peeling portion 162 close to the photosensitive drum 61.

Figure 9:
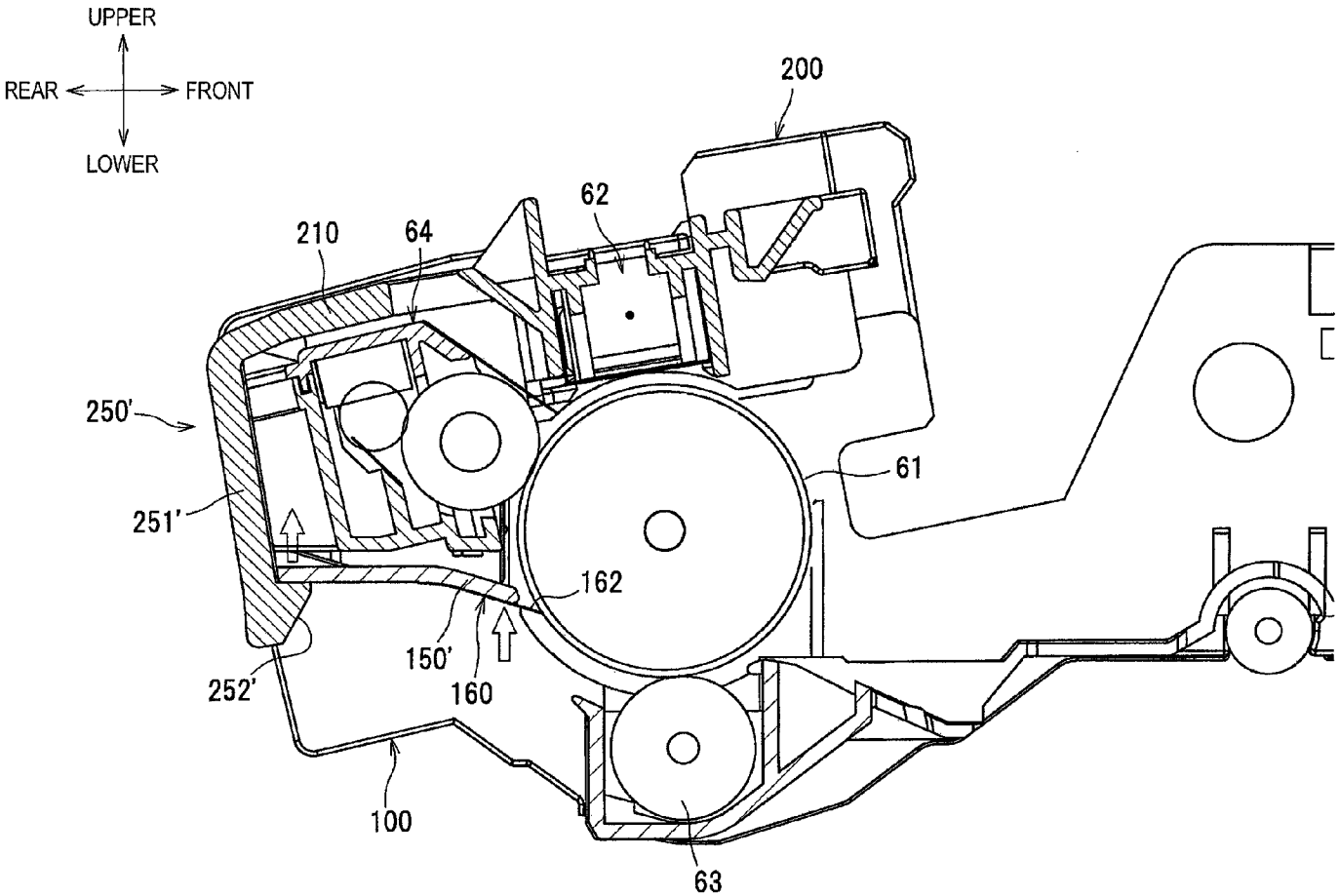
FIG. 9 is an enlarged cross-sectional view of a photosensitive cartridge according to a modified example.

In supplement, in the modified example illustrated in FIG. 9, the connecting wall portion 150' is formed in a substantially plate shape that elongates in the left-right direction and includes only the lower wall portion 152 according to the above-described exemplary embodiment. Further, the pressing portion 250' includes an arm portion 251' provided near the center in the left-right direction of the upper frame 200 and extending from the rear end portion of the upper wall portion 210 downwards, and a claw portion 252' projecting from the lower end portion of the arm portion 251' frontward and engaged with the lower surface of the rear end portion of the connecting wall portion 150'.

In the above-described modified example, the lower frame 100 (connecting wall portion 150') and the upper frame 200 (pressing portion 250') are formed in dimensions in which the claw portion 252' can press the rear end portion of the connecting wall portion 150' upwardly when the upper frame 200 is assembled with the lower frame 100. Further, the claw portion 252' also has the same function as the engaging portion 240 (the function of engaging the upper frame 200 with the lower frame 100) according to the above-described exemplary embodiment.

According to the configuration of the above-described exemplary embodiment (see FIG. 8), since the vertical length of the pressing portion 250 (base portion 251) can be set to be shorter than the vertical length of the pressing portion 250' (arm portion 251') illustrated in FIG. 9, it is possible to ensure the strength of the pressing portion 250. Through this, the pressing of the connecting wall portion 150 by the pressing portion 250 is stabilized, and thus it is possible to stably suppress the separation of the peeling portion 162 from the photosensitive drum 61.

In the above-described exemplary embodiment, although the plurality of peeling members 160 having the same shape are attached to the connecting wall portion 150 (second wall portion), the present invention is not limited thereto, and the peeling members may have different shapes. For example, referring to FIG. 4, the peeling members 160 according to the above-described exemplary embodiment may be attached to the both ends of the left-right direction of the connecting wall portion 150, and peeling members having the attachment portions 161 having the long left-right length (four peeling members integrally formed in the center of FIG. 4) may be attached near the center of the left-right direction.

In the above-described exemplary embodiment, although the peeling members 160 are attached side by side in the left-right direction of the connecting wall portion 150, the present invention is not limited thereto. For example, as illustrated in FIG. 10, only one peeling member 160' may be attached to the connecting wall portion 150 (lower wall portion 152).

Figure 10:
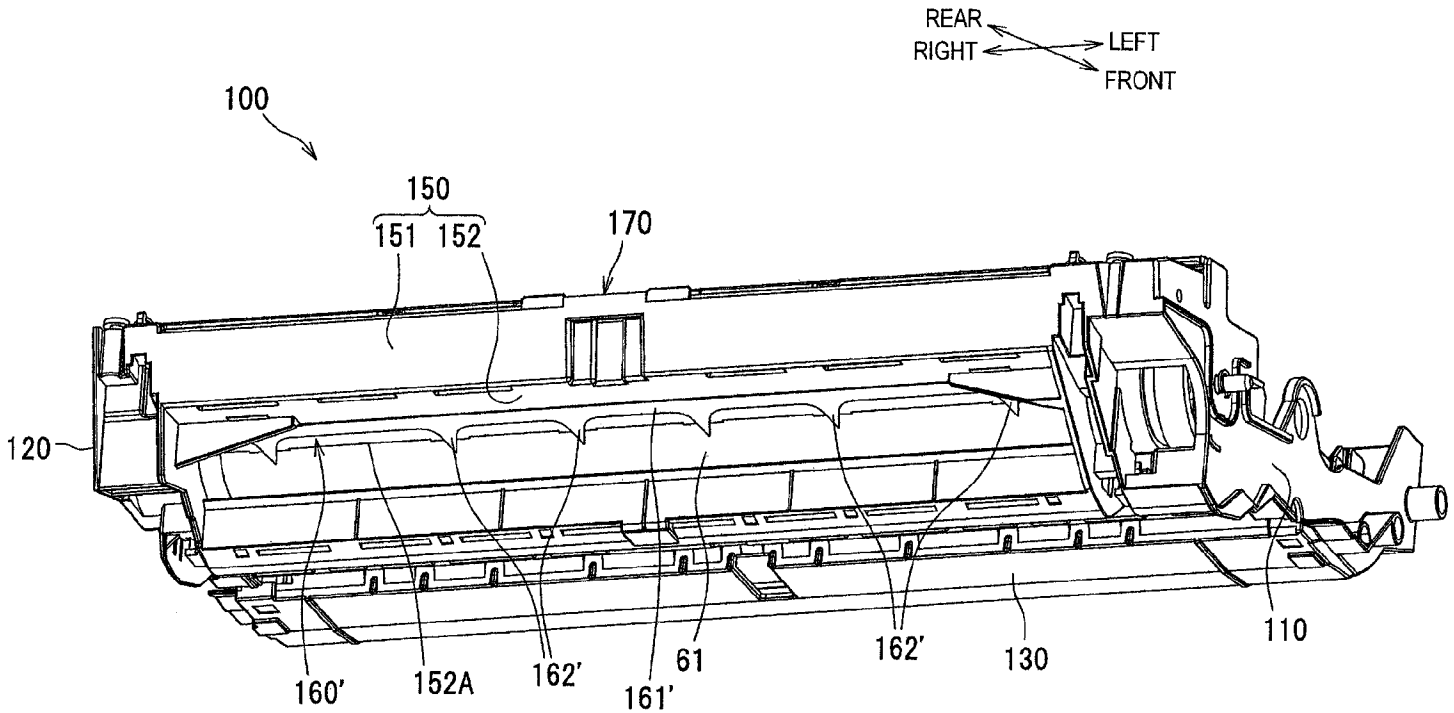
FIG. 10 is a perspective view of a rear portion of a lower frame to which a peeling member is attached as seen from the lower side thereof according to a modified example.

In supplement, in the modified example illustrated in FIG. 10, a peeling member 160' includes an attachment portion 160' formed in a substantially rectangular shape that elongates in the left-right direction of the connecting wall portion 150, and a plurality of peeling portions 162' projecting from the attachment portion 161' toward the photosensitive drum 61. According to the peeling member 160', since it is possible to provide the plurality of peeling portions 162' at once by attaching only one peeling member 160' to the connecting wall portion 150, the cartridge manufacturing process can be simplified in comparison to the configuration in which the plurality of peeling members 160 are attached.

In the above-described exemplary embodiment, although the distal end of the peeling portion 162 is in contact with the surface of the photosensitive drum 61 (image carrier), the present invention is not limited thereto. For example, if it is possible to sufficiently complete the function of peeling off the sheet from the image carrier, the peeling portion may be provided in a state where a predetermined space exists between the distal end thereof and the surface of the image carrier.

In the above-described exemplary embodiment, although the plurality of peeling portions 162 are provided side by side in the left-right direction (axis direction of the image carrier), the present invention is not limited thereto. For example, if it is possible to sufficiently complete the function of peeling off the sheet from the image carrier, only one peeling portion may be provided.

In the above-described exemplary embodiment, although the peeling 160 is formed of a sheet such as a synthetic sheet, the present invention is not limited thereto. That is, if it is possible to sufficiently complete the function of peeling off the sheet from the image carrier, the peeling member may be formed of other materials, for example, resin films such as PET.

In the above-described exemplary embodiment, although the cleaning unit 64 is arranged between the photosensitive drum 61 (image carrier) and the connecting wall portion 150, the present invention is not limited thereto. For example, referring to FIG. 8, in the case where the process cartridge 5 is not provided with the cleaning unit 64, a charger 62 may be provided between the photosensitive drum 61 and the connecting wall portion 150. Through this, no member is arranged on the upper portion of the photosensitive drum 61, and thus by reducing the dimensions in the upper-lower direction of the left and right side wall portions 110 and 120, it is possible to miniaturize the process cartridge 5 (photosensitive cartridge 6).

In the above-described exemplary embodiment, although the charger 62 is exemplified as the charging portion, the charger may be a scorotron type charger, a corotron type charger, or a pin array charger. Further, the charging portion is not limited to the charger, but may be, for example, a charging roller or the like.

In the above-described exemplary embodiment, although the cleaning unit that is assembled with the lower frame 100 is exemplified as the cleaning portion, the present invention is not limited thereto. For example, referring to FIG. 8, a storage portion or the like for storing toner in the lower frame 100 may be directly formed, and the lower frame 100 may be configured to directly support the cleaning roller 64A, the collection roller 64B, and the scrapping film 64C, as another example of the cleaning portion. Further, the member that collects the toner or the like from the surface of the photosensitive member is not limited to the roller, but may be, for example, a blade type member.

In the above-described exemplary embodiment, although the transfer roller 63 is exemplified as the transfer portion, the present invention is not limited thereto, and the transfer portion may be, for example, a transfer charger or the like.

In the above-described exemplary embodiment, although the process cartridge 5, in which the developer cartridge 7 is detachable with respect to the photosensitive cartridge 6, is exemplified as the cartridge, the present invention is not limited thereto. For example, the cartridge may be a photosensitive cartridge 6 according to the above-described exemplary embodiment or a process cartridge in which the photosensitive cartridge 6 and the developer cartridge 7 according to the above-described exemplary embodiment are integrally (non-detachably) formed.

In the above-described exemplary embodiment, although the laser printer 1 that forms monochrome images is exemplified as the image forming apparatus that uses the cartridge according to the present invention, the present invention is not limited thereto, and may be, for example, a printer that forms color images. Further, the image forming apparatus is not limited to a printer, but may be, for example, a copying machine or a multifunction machine having a scanning device such as a flat bed scanner or the like.

In the above-described exemplary embodiment, although the sheet S, such as plain sheet or postcard, is exemplified as the sheet, the present invention is not limited thereto, and the sheet may be, for example, an OHP sheet or the like.

What is claimed is:

1. A cartridge comprising:

an image carrier on which a developer image is configured to be formed;

a first frame having a pair of first wall portions rotatably supporting the image carrier and a second wall portion extending along an axis direction of the image carrier to connect the pair of first wall portions, the pair of first wall portions and the second wall portion surrounding the image carrier;

a second frame attached to the first frame so as to cover the image carrier that is surrounded by the pair of first wall portions and the second wall portion;

a peeling member having a peeling portion projecting from the second wall portion toward the image carrier and being configured to peel off a sheet from the image carrier by the peeling portion; and a pressing portion provided to the second frame, which is configured to move the peeling portion closer to the image carrier by pressing and elastically deforming the second wall portion.

2. The cartridge according to claim 1, wherein the pressing portion is provided to a center in the axis direction.

3. The cartridge according to claim 1, wherein an engaging portion, which is engaged with the second wall portion when the second frame is attached to the first frame, is provided to a center of the second frame in the axis direction, and wherein the pressing portion is provided adjacent to the engaging portion in the axis direction.

4. The cartridge according to claim 3, wherein the pressing portion is provided on both sides of the engaging portion in the axis direction.

5. The cartridge according to claim 3, wherein the engaging portion has an extension portion which extends from the second frame and is configured to deform and a claw portion provided to an end portion of the extension portion and engaged with the second wall portion, and wherein the pressing portion has a base portion extending along the extension portion from the second frame and a pressing projection portion projecting from the base portion in a pressing direction.

6. The cartridge according to claim 1, further comprising a charging portion configured to charge a surface of the image carrier, wherein the charging portion is arranged between the image carrier and the second wall portion.

7. The cartridge according to claim 1, further comprising a cleaning portion configured to clean a surface of the image carrier, wherein the cleaning portion is arranged between the image carrier and the second wall portion.

8. The cartridge according to claim 1, wherein a distal end of the peeling portion is in contact with a surface of the image carrier.

9. The cartridge according to claim 1, wherein the peeling member is elongated from one end of the second wall portion in the axis direction toward another end of the second wall portion in the axis direction and has an attachment portion attached to the second wall portion and at least one peeling portion projecting from the attachment portion toward the image carrier.

10. The cartridge according to claim 1, wherein the peeling member has an attachment portion attached to the second wall portion and at least one peeling portion projecting from the attachment portion toward the image carrier, and wherein a plurality of the peeling members are attached side by side in the axis direction.

11. The cartridge according to claim 1, wherein a plurality of peeling portions are provided side by side in the axis direction.

12. The cartridge according to claim 1, further comprising a transfer portion configured to transfer the developer image that is formed on the image carrier to a sheet.

* * * * *